US009737107B2

(12) United States Patent
Xiong et al.

(10) Patent No.: US 9,737,107 B2
(45) Date of Patent: Aug. 22, 2017

(54) HEADGEAR WITH A SELF-ADAPTIVE, ELASTOMERIC NAPE BELT

(71) Applicant: Honeywell International Inc., Morristown, NJ (US)

(72) Inventors: Jianyou Xiong, Cranston, RI (US); Joseph Rodrigues, Smithfield, RI (US); Oliver Li, Shanghai (CN); Jie Zhu, Shanghai (CN)

(73) Assignee: HONEYWELL INTERNATIONAL, INC., Morristown, NJ (US)

( * ) Notice: Subject to any disclaimer, the term of this patent is extended or adjusted under 35 U.S.C. 154(b) by 211 days.

(21) Appl. No.: 14/631,963

(22) Filed: Feb. 26, 2015

(65) Prior Publication Data

US 2016/0249701 A1 Sep. 1, 2016

(51) Int. Cl.
*A42B 3/08* (2006.01)
*A42B 3/14* (2006.01)

(52) U.S. Cl.
CPC ..... *A42B 3/085* (2013.01); *A42B 3/14* (2013.01); *A42B 3/142* (2013.01)

(58) Field of Classification Search
CPC ..... A42B 3/085; A42B 3/14; A42B 3/142; A42B 3/145
USPC ..... 2/421, 416, 417, 418, 420
See application file for complete search history.

(56) References Cited

U.S. PATENT DOCUMENTS 3,354,468 A * 11/1967 Bowers, Jr. ..... A42B 3/142 2/421
3,388,405 A * 6/1968 Simpson ..... A42B 3/142 2/418
3,510,879 A * 5/1970 Webb ..... A42B 3/14 2/416
3,555,560 A * 1/1971 Rascke ..... A42B 3/14 2/416
4,263,679 A 4/1981 Erlendson
4,293,960 A * 10/1981 Palmaer ..... A42B 3/14 2/416
5,896,586 A * 4/1999 Freund ..... A42B 3/145 2/416
6,314,587 B1 * 11/2001 Fang ..... A42B 3/145 2/183
6,760,927 B2 * 7/2004 Guay ..... A42B 3/145 2/418

(Continued)

FOREIGN PATENT DOCUMENTS

CA 2804667 A1 1/2012
DE 102010026998 A1 1/2012

(Continued)

*Primary Examiner* — Alissa L Hoey
(74) *Attorney, Agent, or Firm* — Barlow, Josephs & Holmes, Ltd.

(57) ABSTRACT

A headgear for a head safety product such as a face shield, hardhat or welding helmet includes a headband with hangers extending therefrom to engage the head safety product being worn, at least one crown strap engaged with the headband to support the headgear over the wearer's head and a self-adjusting elastomeric nape belt configured to extend over the occipital portions of the wearer's head. The elastomeric nape belt depends from symmetric rear strap extensions of the headband and is configured to elastically self-adjust to the occipital area of the wearer's head.

4 Claims, 10 Drawing Sheets

(56) References Cited

U.S. PATENT DOCUMENTS

| | | | | |
|---|---|---|---|---|
| 7,114,197 | B2 * | 10/2006 | Garneau | A42B 3/145 2/418 |
| 7,213,271 | B1 * | 5/2007 | Bielefeld | A42B 3/14 2/181 |
| 8,348,448 | B2 * | 1/2013 | Orozco | A42B 1/244 2/171 |
| 8,584,265 | B2 * | 11/2013 | Lilenthal | A42B 3/14 2/417 |
| 8,745,770 | B2 | 6/2014 | Ahlgren et al. | |
| 8,850,624 | B2 | 10/2014 | Gleason | |
| 9,066,552 | B2 | 6/2015 | Ahlgren et al. | |
| 9,427,040 | B2 * | 8/2016 | Leyland | A42B 3/04 |
| 2004/0255370 | A1 * | 12/2004 | Moeller | A42B 3/145 2/416 |
| 2005/0262619 | A1 * | 12/2005 | Musal | A42B 3/08 2/421 |
| 2009/0293180 | A1 * | 12/2009 | Grau | A42B 3/145 2/417 |
| 2010/0050324 | A1 * | 3/2010 | Musal | A42B 3/145 2/417 |
| 2012/0144565 | A1 | 6/2012 | Huh | |
| 2013/0191973 | A1 * | 8/2013 | Pfanner | A42B 3/145 2/421 |
| 2013/0205478 | A1 | 8/2013 | Pfanner et al. | |
| 2013/0239303 | A1 * | 9/2013 | Cotterman | A42B 3/08 2/417 |
| 2014/0101828 | A1 * | 4/2014 | Sugerman | A42B 3/085 2/411 |
| 2014/0109301 | A1 * | 4/2014 | Hall | A42B 3/142 2/416 |

FOREIGN PATENT DOCUMENTS

| | | | |
|---|---|---|---|
| EP | 2207443 | B1 | 9/2011 |
| WO | 2012007474 | A1 | 1/2012 |

* cited by examiner

HEADGEAR WITH A SELF-ADAPTIVE, ELASTOMERIC NAPE BELT

BACKGROUND

The present specification relates to a headgear or suspension of the type used in a head safety product such as a face shield, hardhat or welding helmet. More particularly, the specification is directed to a self-adaptive, elastomeric nape belt to improve the fit, function, stability and comfort of the headgear.

SUMMARY OF THE DISCLOSURE

An improved self-adjusting headgear for a head safety product, such as a face shield, hardhat or welding helmet, includes an elastomeric nape belt to improve the fit, function, stability and comfort of the headgear. The nape belt is elastomeric and has relief openings to facilitate conformation of the nape belt to the shape of the head. The nape belt acts as a conformable tension spring to buffer or absorb the tension between the horizontal head band and the head and more equally distribute pressure across the head. In an exemplary embodiment, the nape band is located in the rear of the headgear to engage the occipital area of the head and includes spaced anchor openings to provide a wide range of adjustment.

In the exemplary embodiment, the head safety product comprises a hard hat having a domed shell and a brim.

The headgear for the head safety product comprises a headband at least partially encircling the wearer's head and a plurality of hangers extending from the headband to support the headgear within the dome of the hard hat. The headband has a front portion configured to extend across a forehead area of the user and further has opposing rearward ends which are free floating and not connected. The front portion of the headband has opposing straps which are provided with interfitting formations that allow adjustable size positions.

The headgear further comprises a crown strap assembly engaged with the headband and extending over the top of the users head. At the rearward ends of the horizontal strap, opposing strap extensions extend downwardly and rearwardly to lower the position of the nape belt and to provide anchor point to for the nape belt.

The nape belt is formed from an elastomeric material and has an elongated central body portion and opposing end portions extending from the central body portion. The opposing end portions are respectively anchored to the opposing strap extensions whereby the elastomeric nape-belt extends across the occipital areas of the wearer's head and elastomerically self-adjusts to the wearer's head.

The opposing end portions of said nape belt include a plurality of longitudinally spaced anchor openings which releasably engage with hooked anchors on the headband extensions. The headband extensions also include slots wherein the end portions of the nape belt extend through the slots and engage the hook anchors. Elastic tension of the nape belt is adjusted by selecting between the anchor openings.

In order to better conform to each individual wearer, the central portion of the nape belt has an upwardly curved upper peripheral edge and a downwardly curved lower peripheral edge. This arrangement displaces tension from the nape belt toward the occipital bone areas of the head rather than centrally at the top of the neck. Additionally, the central body portion of the nape belt has three vertically extending, longitudinally spaced openings to further facilitate elastomeric conformation of the nape belt to the occipital areas of the wearer's head. In the exemplary embodiment, the central relief opening is generally oval in shape while the two outer relief openings are symmetrically opposing generally trapezoidal openings having longer dimensions extending toward the upper and outer corners.

Accordingly, an objective is to provide a headgear that improves fit, function, stability and comfort.

Another objective is to provide a nape belt for a headgear that is flexible and self-adjusting.

Yet another objective is to provide a headgear that conforms to and engages the head below the equatorial region to provide an improved fit.

Still another objective is to provide an elastic nape belt that buffers tension and more equally distributes pressure between the headband and the head.

Finally, it is yet another objective to provide a headgear which is readily adaptable to both new head safety products and head safety products already deployed in the field.

Other objects, features and advantages shall become apparent as the description thereof proceeds when considered in connection with the accompanying illustrative drawings.

BRIEF DESCRIPTION OF THE DRAWINGS

An exemplary embodiment will now be described further by way of example with reference to the following examples and figures, which are intended to be illustrative only and in no way limiting upon the scope of the disclosure.

DETAILED DESCRIPTION OF THE EXEMPLARY EMBODIMENT

Figure 1:
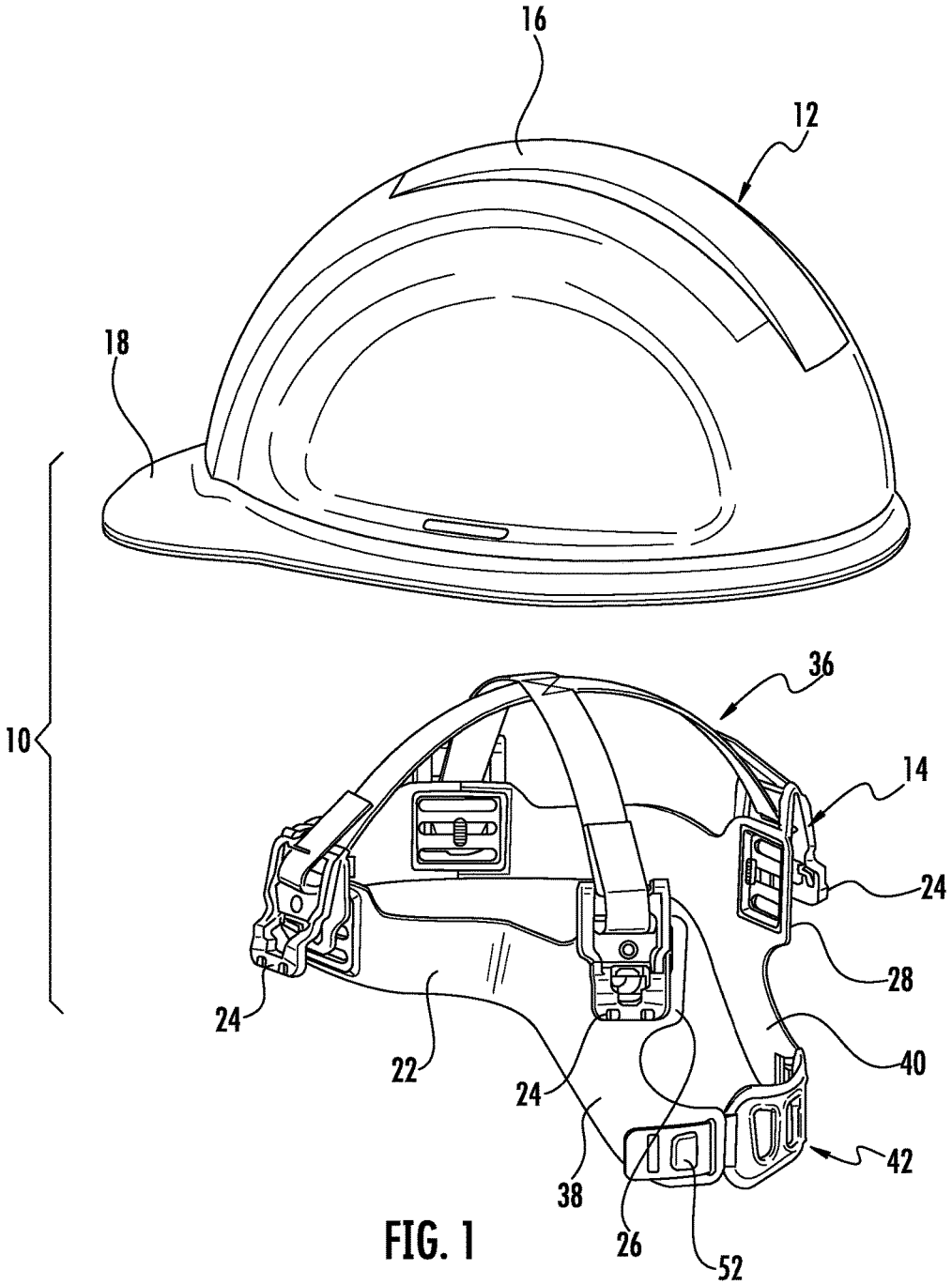
FIG. 1 is an exploded perspective view of an exemplary embodiment of a hard hat employing the present headgear.

Generally, an improved headgear with self-adaptive nape belt is illustrated and described herein to improve the fit, function, stability and comfort of the headgear. The headgear includes an elastomeric, flexible, spring-like nape belt connected across the rear portion of the headband. The elastomeric nape belt adjustably secures the headband in a manner that buffers tension between the headband and the head and more equally distributes pressure across the head resulting in better comfort.

Referring to the drawing figures, the exemplary embodiment of the head safety product is a hard hat assembly 10 comprising a hard hat 12 and the present headgear assembly 14. While the exemplary embodiment is illustrated in conjunction with a hard hat, it should also be understood that the headgear is equally contemplated for use in other head safety products, including but not limited to face shields, welding helmets, head lamps, medical head gear and products, wearable head equipment, and consumer headgear and products.

Figure 2:
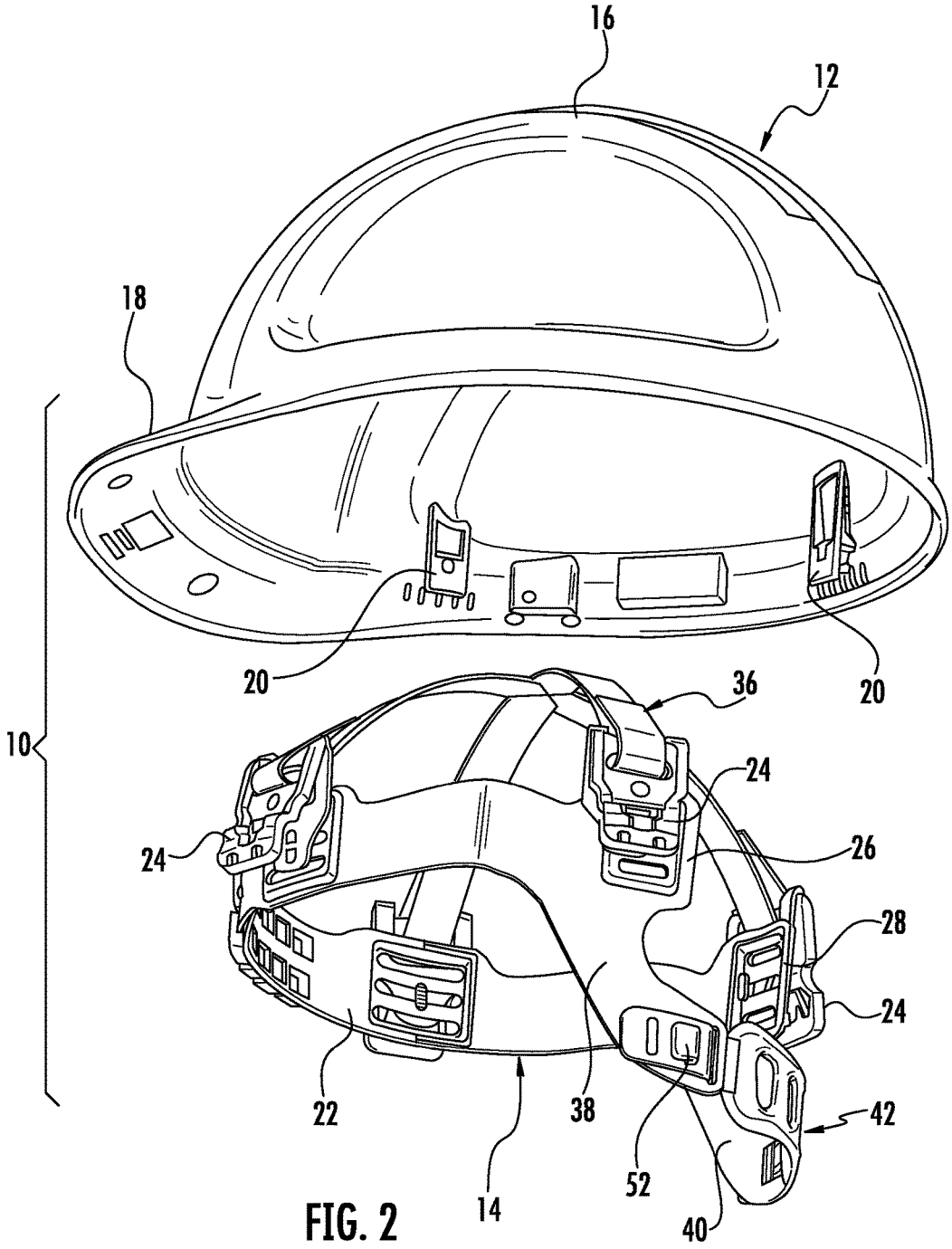
FIG. 2 is another perspective view of the hard hat and headgear showing the inner surfaces of the hard hat.
Figure 3:
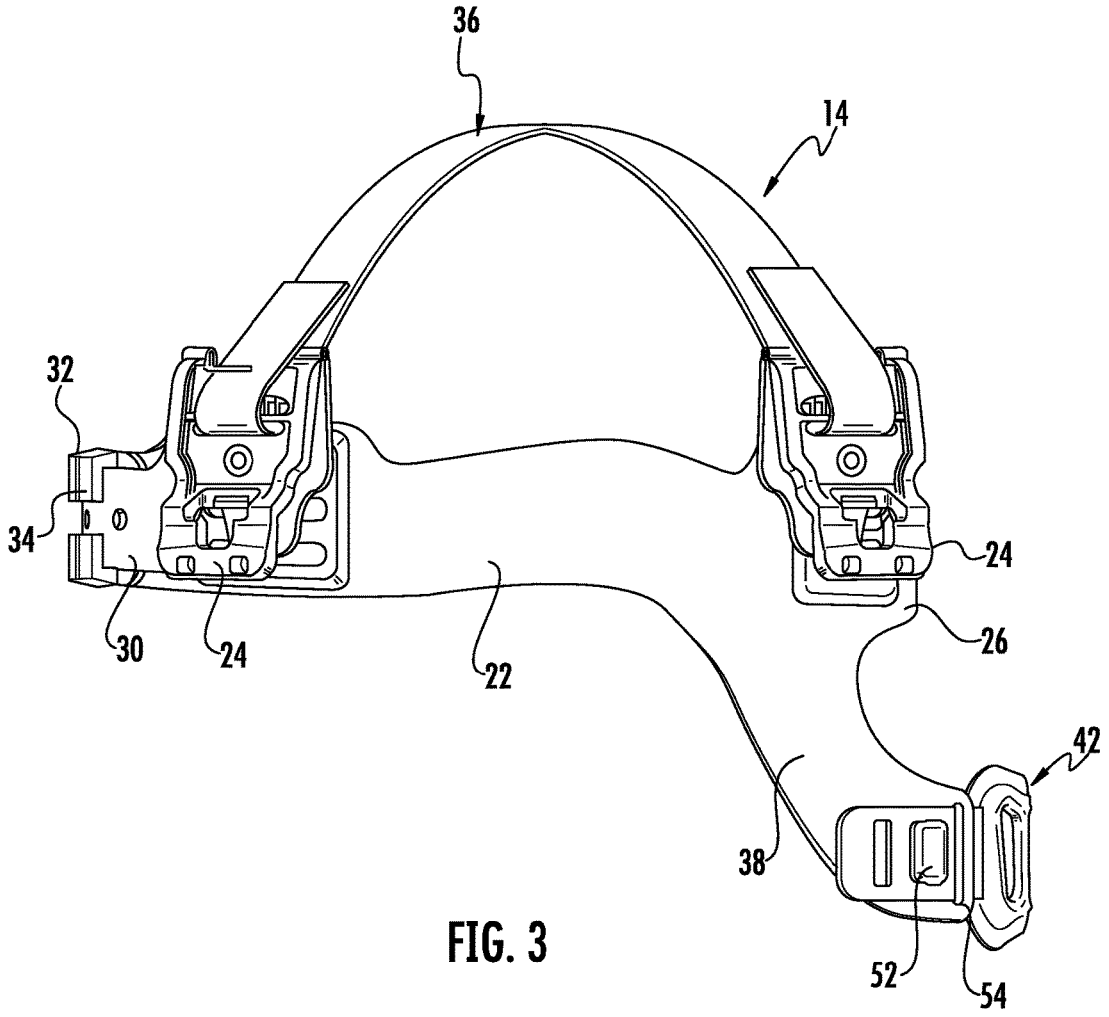
FIG. 3 is a side view of the headgear.
Figure 4:
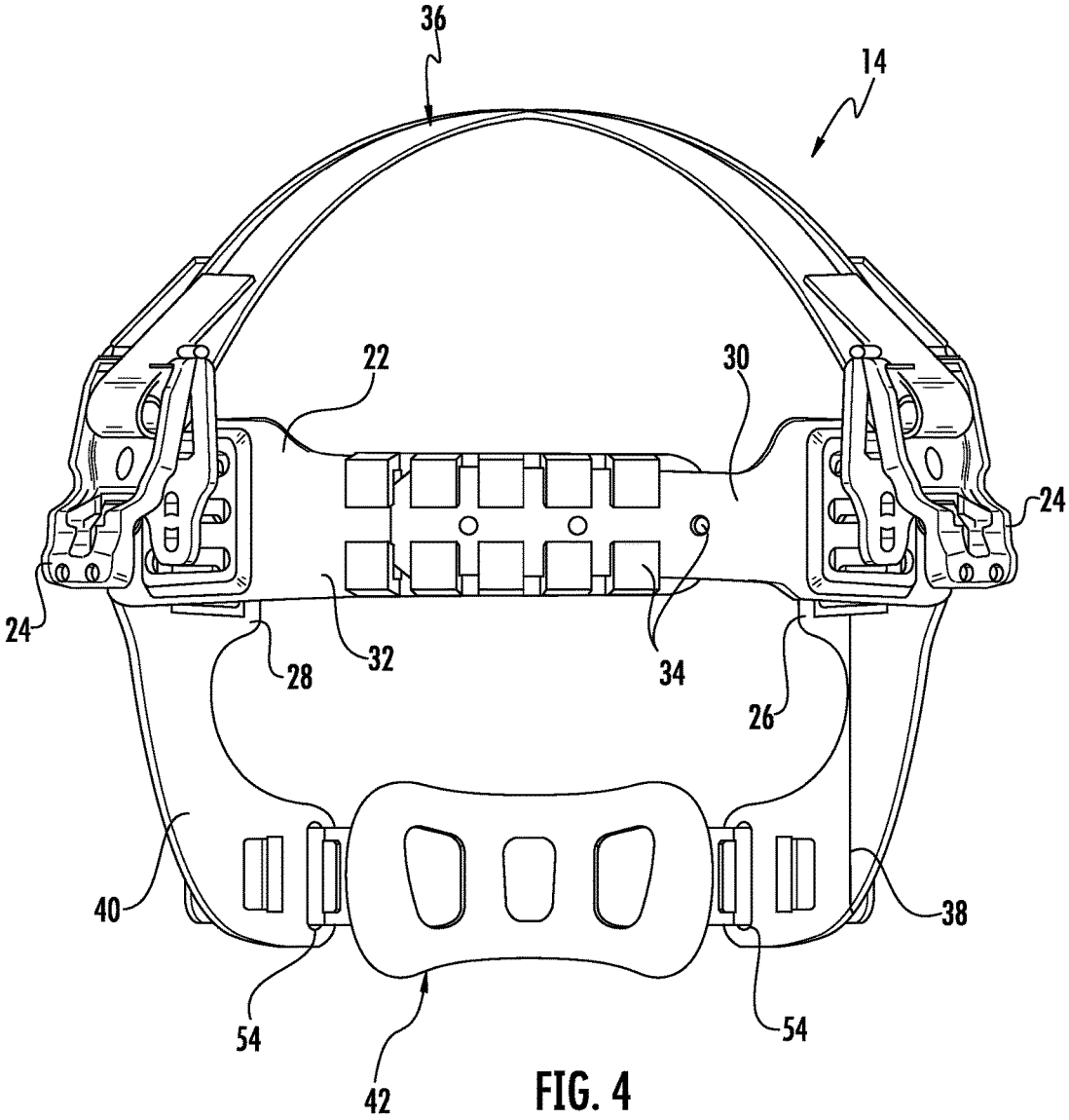
FIG. 4 is a front view of the headgear.
Figure 5:
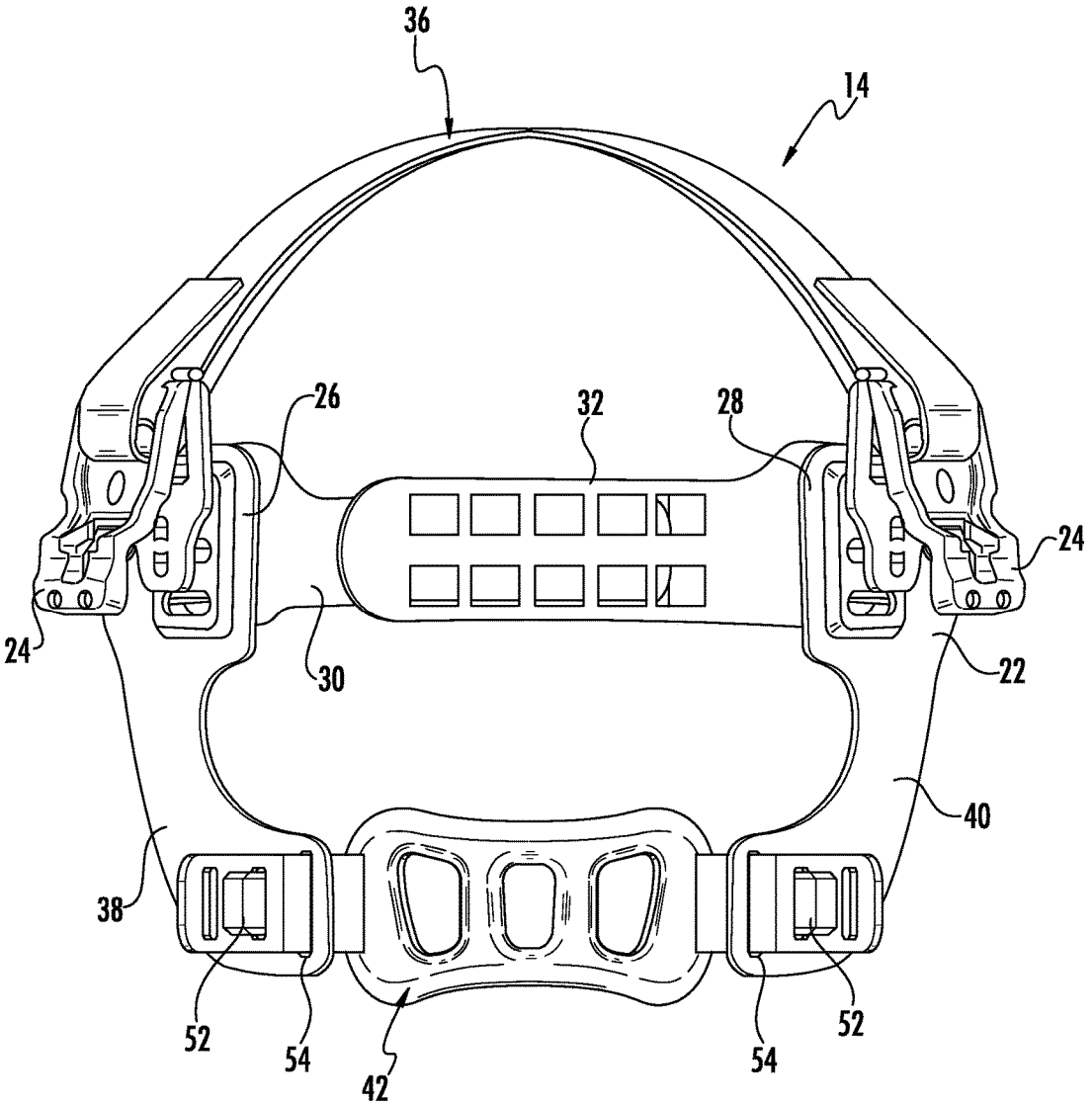
FIG. 5 is a rear view of the headgear.
Figure 6:
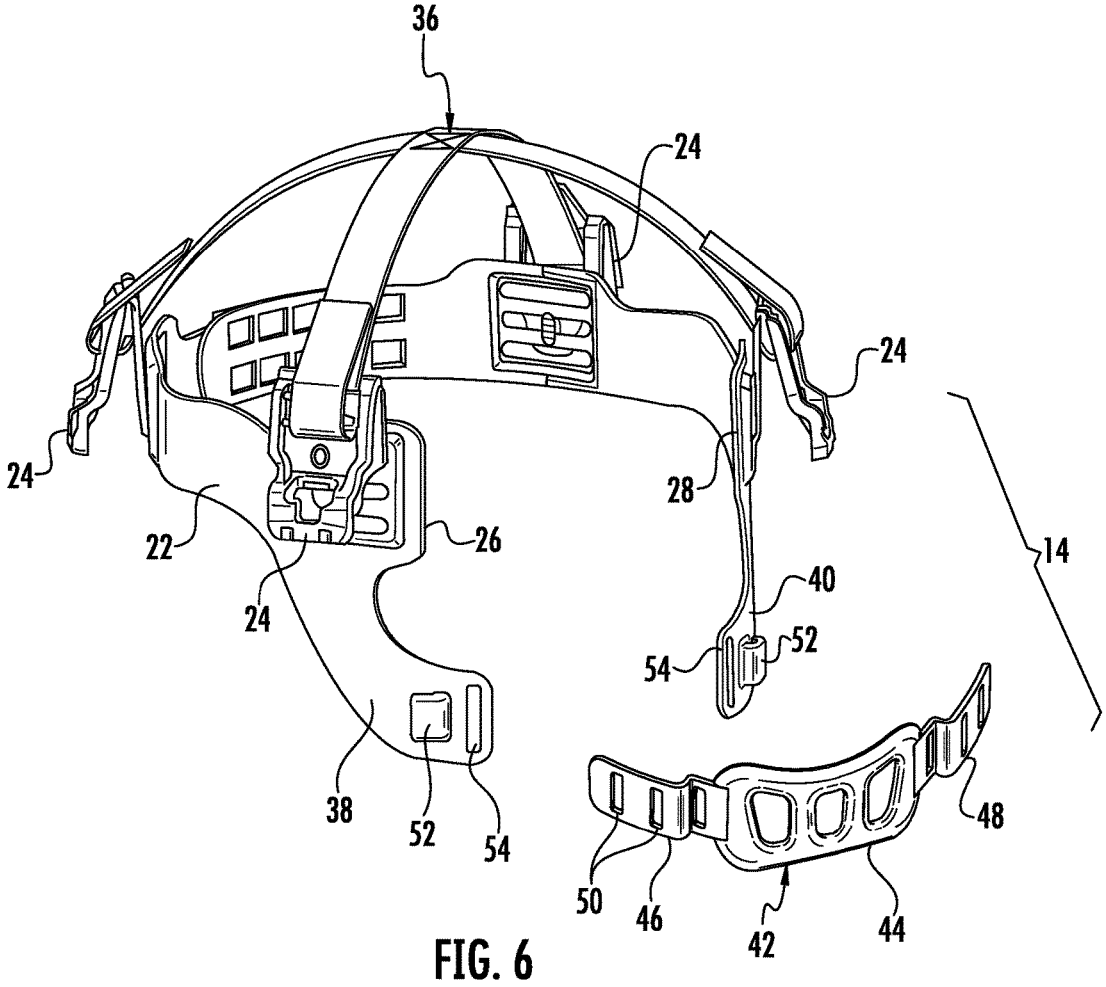
FIG. 6 is an exploded perspective view of the headgear showing the nape belt in isolation.
Figure 7:
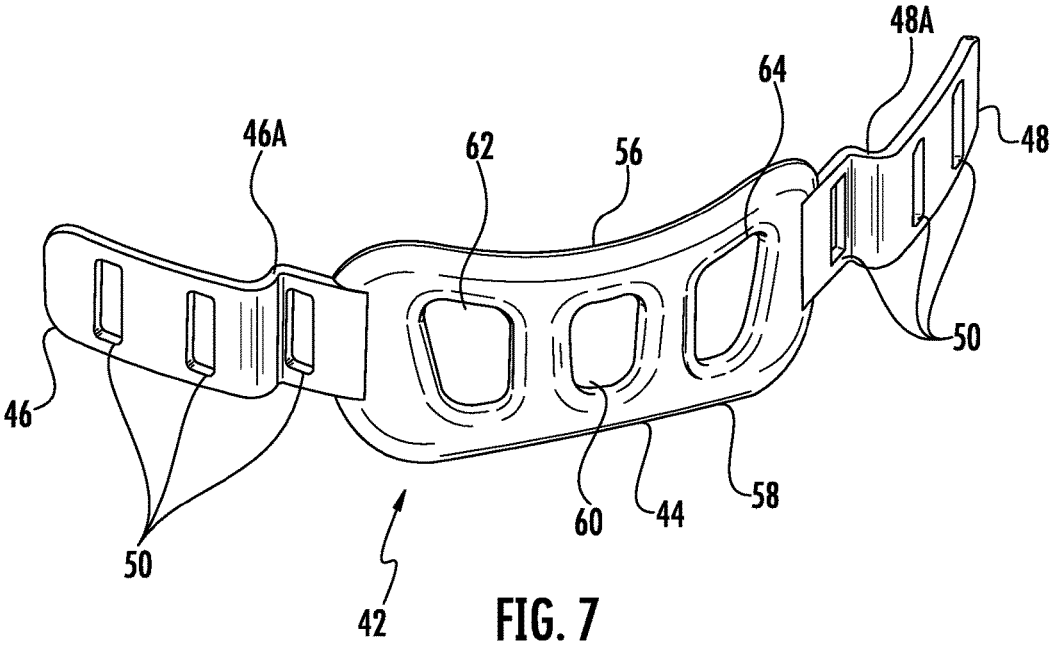
FIG. 7 is a perspective view of the elastomeric nape belt.

The hard hat 12 is conventional in the art and generally includes a domed shell 16 and a brim 18. The interior of the hard hat 12 includes various attachment points 20 for securing the headgear 14 within the dome 16 (see FIG. 2).

The headgear 14 for the head safety product comprises a horizontally extending headband 22 at least partially encircling the wearer's head and a plurality of hangers 24 extending from the headband 14 which engage the attachment points 20 to support the headgear 14 within the dome 16 of the hard hat 12. The headband 22 has a front portion configured to extend across a forehead area of the user and further has opposing rearward ends 26,28 which are free floating and not connected. The front portion of the headband 22 has opposing straps 30,32 which are provided with interfitting and interlocking formations 34 that allow user adjustable coarse sizing positions. The headband 22 can be molded or otherwise formed from a flexible plastic material as would be suitable for the purpose.

The headgear 14 further comprises a crown strap assembly 36 engaged with the headband 22 and extending over the top of the users head. The crown strap assembly 36 can be made from plastic or fabric straps, or other suitable material for comfort.

At the rearward ends of the horizontal strap, opposing strap extensions 38,40 extend downwardly and rearwardly to lower the position of the elastomeric nape belt 42 and to provide anchor point to for the elastomeric nape belt 42.

The nape belt 42 is formed from an elastomeric material and has an elongated central body portion 44 and opposing end portions 46,48 extending from the central body portion 44. The opposing end portions 46,48 are respectively anchored to the opposing strap extensions 38,40 whereby the elastomeric nape belt extends across the occipital areas of the wearer's head and elastomerically self-adjusts to the wearer's head.

The opposing end portions 46,48 of the nape belt 42 include a plurality of longitudinally spaced anchor openings 50 which releasably engage with hooked anchors 52 on the headband extensions 38,40. The headband extensions 38,40 also include slots 54 wherein the end portions 46,48 of the nape belt 42 extend through the slots 54 and engage the hook anchors 52. Elastic tension of the nape belt 42 is adjusted by selecting between the spaced anchor openings 50.

Figure 10:
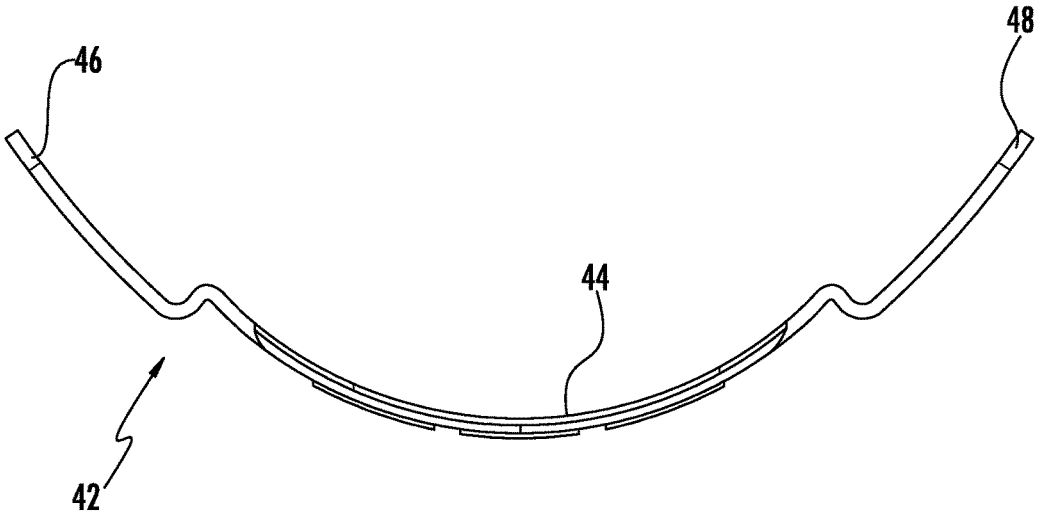
FIG. 10 is a top view thereof.

It can also be seen that the end portions 46,48 include an offset shoulder 46A,48A which moves the curvature of the central portion 44 inwardly in relation to the curvature of the end portions 46,48 (see FIG. 10). This arrangement moves the central portion 44 of the nape belt 42 inwardly toward the wearer's head and improves comfort by helping to prevent the plastic headband extensions 38,40 from rubbing against the wearer's head.

Figure 8:
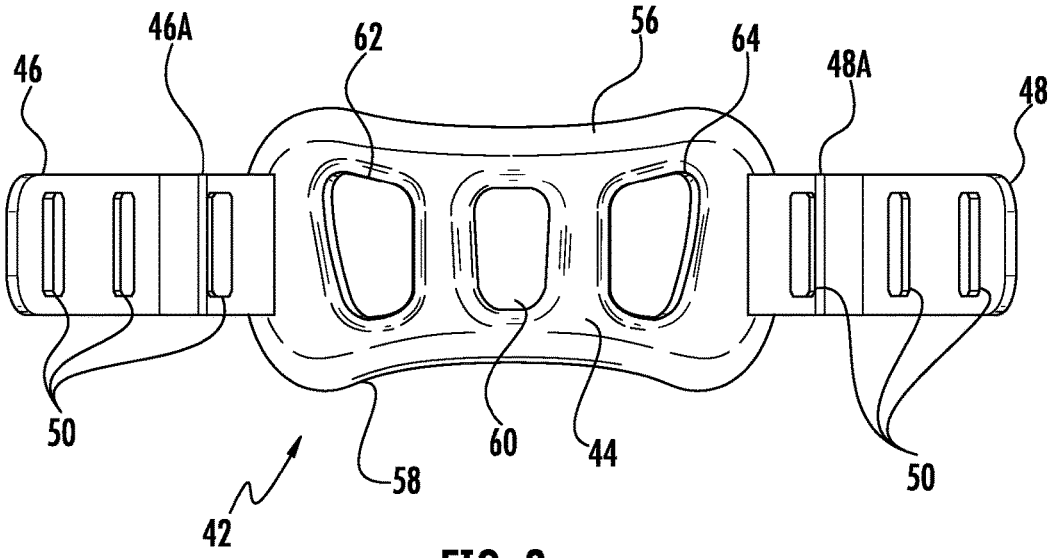
FIG. 8 is a front view thereof.
Figure 9:
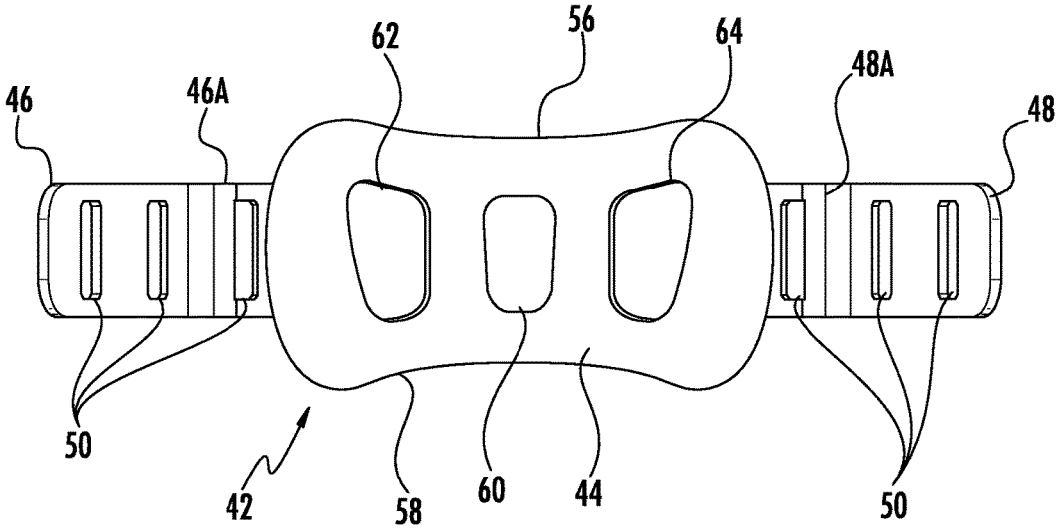
FIG. 9 is a rear view thereof.

In order to better conform to each individual wearer, the central portion 44 of the nape belt 42 has an upwardly curved upper peripheral edge 56 and a downwardly curved lower peripheral edge 58 (See FIGS. 8 and 9). This arrangement displaces tension from the nape belt 42 toward the occipital bone areas of the head rather than centrally at the middle of the neck. Additionally, the central body portion 44 of the nape belt 42 has three vertically extending, longitudinally spaced relief openings 60,62,64 to further facilitate elastomeric conformation of the nape belt 42 to the occipital areas of the wearer's head. In the exemplary embodiment, the central relief opening 60 is generally oval in shape while the two outer relief openings 62,64 are symmetrically opposing generally trapezoidal openings having longer dimensions extending toward the upper and outer corners thereof.

In summary, it can be appreciated from the foregoing description and illustrations that the shape and configuration of the elastomeric nape belt 42 is such that it conforms to and gently cups the head below the equatorial region and gently grips around the mastoid bone area (occipital area) creating a more secure fit for various shaped heads. The nape belt 42 is completely passive and requires no additional effort by the end user to use or adjust once the nape belt 42 is initially adjusted by selecting the anchor points to set it to the appropriate width. In use, the nape belt 42 self-adjusts and deflects the appropriate amount depending on the shape of the wearer's head. The nape belt 42 is also self-aligning allowing it to gently conform in shape to the user's head and seat itself in a manner that equally distributes contact and pressure on the rear of the user's head. Because the nape belt 42 works in a cupping manner securely below the equatorial region of the head, it provides a secure fit and feeling with far less tension and pressure than a standard headgear arrangement.

For these reasons, the present headgear 14 is believed to represent significant advancements in the art, which have substantial commercial merit.

While there is shown and described herein certain specific structure embodying the present headgear, it will be manifest to those skilled in the art that various modifications and rearrangements of the parts may be made without departing from the spirit and scope of the underlying concept and that the same is not limited to the particular forms herein shown and described except insofar as indicated by the scope of the appended claims.

What is claimed is:

1. A headgear for a head safety product comprising:

a headband configured to at least partially encircle a wearer's head, the headband having a front portion configured to extend across a forehead area of the user and further having opposing rearward ends;

a plurality of hangers extending from the headband;

a crown assembly engaged with the headband;

opposing headband extensions extending downwardly and rearwardly from said opposing rearward ends of said headband; and an elastomeric nape belt having an elongated central body portion and opposing end portions extending from said central body portion, said opposing end portions being respectively anchored to said opposing headband extensions whereby said elastomeric nape-belt is configured to extend across occipital areas of the wearer's head and to elastomerically self-adjust to said wearer's head, wherein the opposing end portions of said nape belt each include a plurality of longitudinally spaced, transversely extending anchor openings which releasably engage with hooked anchors on said headband extensions, said hooked anchors extending outwardly and forwardly from said head band extensions, said headband extensions further including transversely extending slots adjacent terminal ends thereof, said opposing end portions of said nape belt extending through said slots and engaging said hooked anchors, whereby an elastic tension of said nape belt can be adjusted by selecting between said anchor openings.

2. The headgear of claim 1 wherein said central body portion of said nape belt has at least one relief opening configured to facilitate elastomeric conformation of the nape belt to the occipital areas of the wearer's head.

3. The headgear of claim 1 wherein said central portion of said nape belt has a plurality of longitudinally spaced relief openings which are configured to facilitate elastomeric conformation of the nape belt to the occipital areas of the wearer's head.

4. The headgear of claim 1 wherein said central portion of said nape belt has an upwardly curved upper peripheral edge and a downwardly curved lower peripheral edge.

* * * * *